US005900855A

United States Patent [19]

Kweon

[11] Patent Number: 5,900,855

[45] Date of Patent: May 4, 1999

[54] METHOD FOR PREVENTING A DIRECT CURRENT SHOCK TO A LIQUID CRYSTAL DISPLAY MODULE

[75] Inventor: Gi-jin Kweon, Pusan, Rep. of Korea

[73] Assignee: Samsung Display Devices Co., Ltd., Kyungki-Do, Rep. of Korea

[21] Appl. No.: 08/797,317

[22] Filed: Feb. 7, 1997

[30] Foreign Application Priority Data

Feb. 28, 1996 [KR] Rep. of Korea ..... 96-5090

[51] Int. Cl.[6] ..... G09G 3/36

[52] U.S. Cl. ..... 345/99; 345/211

[58] Field of Search ..... 345/52, 87, 98, 345/99, 211–213; 361/83, 89, 94; 348/730

[56] References Cited

U.S. PATENT DOCUMENTS 5,731,812 3/1998 Herrington ..... 345/211

FOREIGN PATENT DOCUMENTS 4-368990 12/1992 Japan .

*Primary Examiner*—Jeffery Brier
*Attorney, Agent, or Firm*—Leydig, Voit & Mayer

[57] ABSTRACT

A method for preventing direct current shock to a liquid crystal display module. In the method, a driving signal of a liquid crystal display, generated by processing signals input from a host via an interface, is enabled only after the lapse of a time period beginning when a voltage is first supplied to the liquid crystal display module from a power source. Accordingly, DC shock to the LCD module is precisely prevented.

4 Claims, 2 Drawing Sheets

METHOD FOR PREVENTING A DIRECT CURRENT SHOCK TO A LIQUID CRYSTAL DISPLAY MODULE

BACKGROUND OF THE INVENTION

The present invention relates to a method for preventing a direct current shock of a liquid crystal display (LCD) module for driving a panel.

FIG. 1 is a block diagram of a general LCD apparatus, the operation of which will be explained as follows. Namely, signals output from a host, for example, a controlling portion of a notebook PC control the LCD module for driving the panel via a setting interface. As shown in FIG. 1, a controller 101 of the host outputs to an LCD module 103 an enable signal $\overline{\text{DISP}}$, a frame signal FRM for initiating each frame of a picture, a data signal DATA, and a shift clock signal SHIFT CK for sequentially shifting the data signal DATA. These signals are input to the LCD module 103 through a setting interface 102. A separate modulation signal generating portion is provided in the LCD module 103.

In the LCD apparatus having the above mentioned configuration, the DC shock of the LCD module means an electrical shock applied to the LCD module due to a time difference between a signal of an inner circuit and a biased voltage when power is supplied to the LCD apparatus. In order to prevent the DC shock of the LCD module, a setting program for making specifications of the LCD apparatus coincide with a timing chart thereof is provided in a conventional technology. However, there is a problem in that a DC shock occurs due to an error between the hardware and software thereof.

SUMMARY OF THE INVENTION

It is an object of the present invention to provide a method for preventing a direct current shock to a liquid crystal display module with a high degree of precision.

To achieve the above object, there is provided a method for preventing a DC shock to an LCD module for generating a driving signal of a liquid crystal display panel by processing signals which are input thereto from a host via an interface, wherein the liquid crystal display module is enabled after the lapse of a predetermined time from the point of time in which a voltage is supplied from a power source.

Here, a host, for example, an enable signal from the notebook personal computer is preferably delayed. Also, a method for delaying the enable signal comprises the steps of inputting signals excluding the enable signal to the liquid crystal display module and inputting a frame signal to delay devices when the voltage is supplied, AND-combining the output signal of the delay devices with the enable signal, and supplying the output signal resulting from the AND-combination to the liquid crystal display module.

BRIEF DESCRIPTION OF THE DRAWINGS

The above objects and advantages of the present invention will become more apparent by describing in detail a preferred embodiment thereof with reference to the accompanying drawings in which.

DETAILED DESCRIPTION OF THE INVENTION

Figure 1:
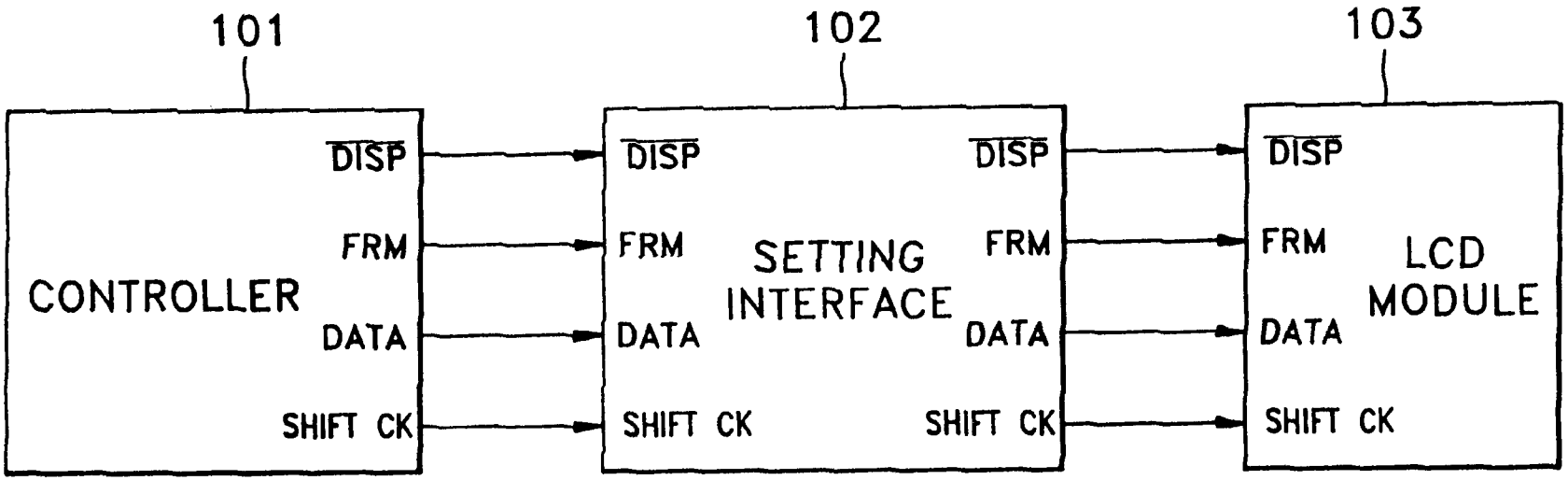
FIG. 1 (PRIOR ART)
FIG. 1 is a block diagram showing the configuration of a general liquid crystal display apparatus.
Figure 2:
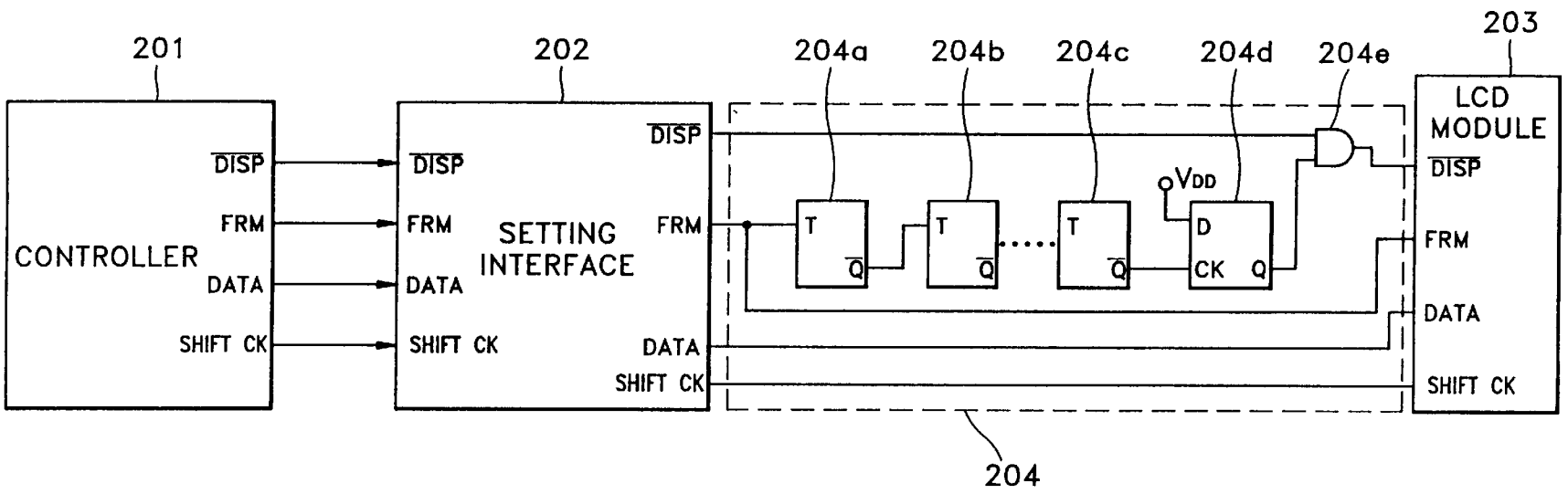
FIG. 2 is a block diagram for describing a method for preventing direct current shock to an LCD module according to the present invention.

FIG. 2 is a block diagram of a liquid crystal display apparatus for preventing direct current shock to an LCD module according to the present invention. As shown in FIG. 2, a controller 201 of a host outputs an enable signal $\overline{\text{DISP}}$, a frame signal FRM for initiating each frame of a picture, a data signal DATA, and a shift clock signal SHIFT CK for sequentially shifting the data signal DATA. The frame signal FRM, data signal DATA, and shift clock signal SHIFT CK are directly input to an LCD module 203 through a setting interface 202. However, the enable signal $\overline{\text{DISP}}$ from the setting interface 202 is input to the LCD module 203 through an enable delaying circuit 204. A separate modulation signal generating portion (not shown) is provided in the LCD module 203. The modulation signal is generated by dividing a frequency of a latch clock signal (not shown) input from the controller 201 to the LCD module 203 through the setting interface 202. Here, the latch clock signal is for latching the data signal DATA which is sequentially shifted by the shift clock signal SHIFT CK in a horizontal-line unit. The modulation signal controls the polarity of the voltage applied to the cell of an LCD panel (not shown).

The enable delaying circuit 204 includes T-type flip-flops 204*a,* 204*b,* and 204*c* for determining the delay time of the enable signal $\overline{\text{DISP}}$ by the frame signal FRM, a D-type flip-flop 204*d* which is serially connected to the final T-type flip-flop 204*c,* and an AND gate 204*e* for AND-combining the enable signal $\overline{\text{DISP}}$ from the setting interface 202 with the output signal of the D-type flip-flop 204d and applying the output signal to the enable terminal of the LCD module 203. Here, the LCD module 203 is enabled when the input enable signal $\overline{\text{DISP}}$ is in a high state. Also, in the T-type flip-flops 204*a,* 204*b,* and 204*c,* the output state of each of the $\overline{\text{Q}}$ terminals is inverted when the signal input to each of T terminals thereof switches from a low state to a high state. In the D-type flip-flop 204*d,* the output of the Q terminal is maintained at a high state from the point of time at which the signal input to a clock terminal CK thereof switches from a high state to a low state. This is because the D input terminal is fixed to a high state by a voltage $V_{DD}$.

The operation of the enable delaying circuit 204 of FIG. 2 is as follows. As shown in FIG. 2, the frame signal FRM from the setting interface 202 is directly applied to the LCD module 203 and to the T input terminal of the first T-type flip-flop 204*a*. When a voltage is supplied from the power source and then the first pulse of the frame signal FRM is output from the setting interface 202, the output of the $\overline{\text{Q}}$ terminal of the first T-type flip-flop 204*a* switches from a high state to a low state. When a second pulse of the frame signal FRM is output, the output of the $\overline{\text{Q}}$ terminal of the second T-type flip-flop 204*b* switches from a low state to a high state since the output of the $\overline{\text{Q}}$ terminal of the first T-type flip-flop 204*a* switches from the low state to the high state. When an n-th pulse of the frame signal FRM is output, the output of the $\overline{\text{Q}}$ terminal of the n-th T-type flip-flop 204*c* switches from a high state to a low state. Accordingly, the Q output of the D-type flip-flop 204*d* and the output of the AND gate 204*e* are switched from a low state to a high state, thus enabling the LCD module 203.

When the number of T-type flip-flops is n and the periods of the clock signals applied to the T-type flip-flops 204*a,* 204*b* and 204*c* are T, the enable signal $\overline{\text{DISP}}$ output from the setting interface 202 is applied to the LCD module 203 after the lapse of a time equal to nT, from the point of time at which the power is applied to a concerned liquid crystal display apparatus. Here, the number n of the T-type flip-flops can be determined according to the specifications and the timing chart of the concerned LCD apparatus. Since the LCD module 203 operates after n periods of the frame signal FRM from the point of time in which the power is applied to the LCD apparatus, the DC shock inflicted to the LCD module can be prevented by effectively removing the time difference between the signal of the inner circuit and the biased power.

The present invention is not restricted to the above embodiments and many variations are possible within the scope and spirit of the present invention by anyone skilled in the art. For example, in case that the LCD module 203 is enabled when the enable signal $\overline{DISP}$ is in a low state, the AND gate 204*e* may be replaced with an OR gate and a $\overline{Q}$ output terminal (not shown) of the D-type flip-flop 204*d* may be connected to an input terminal of the OR gate.

As described above, according to the method for preventing the DC shock of the LCD module of the present invention, since the DC shock of the LCD module can be prevented with a high degree of precision, productivity, quality and reliability of the LCD apparatus can be improved.

What is claimed is:

1. A method for preventing direct current shock to a liquid crystal display module in generating a driving signal for a liquid crystal display panel by processing signals input from a host via an interface, the method including:

enabling the liquid crystal display module by applying an enable signal output by the interface after lapse of a predetermined time from the time at which a voltage is first supplied to the liquid crystal display module from a power source, wherein delaying the enable signal comprises inputting signals, excluding the enable signal, to the liquid crystal display module and inputting a frame signal to delay devices when the voltage is first supplied;

AND-combining an output signal of the delay devices and the enable signal; and supplying an output signal resulting from the AND-combining to the liquid crystal display module.

2. The method of preventing direct current shock to a liquid crystal display module as claimed in claim 1, wherein the delay devices comprise serially connected T-type flip-flops.

3. The method of preventing direct current shock to a liquid crystal display module as claimed in claim 1, including enabling the liquid crystal display module only after as many clock pulses as delay devices have been generated.

4. The method of preventing direct current shock to a liquid crystal display module as claimed in claim 1, wherein the host is a notebook personal computer.

* * * * *